US006407015B1

(12) United States Patent
Saika

(10) Patent No.: US 6,407,015 B1
(45) Date of Patent: Jun. 18, 2002

(54) SHEET CAPABLE OF CONTROLLING QUANTITY OF PASSING FLUID

(75) Inventor: Isamu Saika, Osaka (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/319,386

(22) PCT Filed: Oct. 6, 1998

(86) PCT No.: PCT/JP98/04512

§ 371 (c)(1),
(2), (4) Date: Jun. 4, 1999

(87) PCT Pub. No.: WO99/18273

PCT Pub. Date: Apr. 15, 1999

(30) Foreign Application Priority Data

Oct. 6, 1997 (JP) ..... 9-272599

(51) Int. Cl.[7] ..... B32B 27/04; B32B 27/12

(52) U.S. Cl. ..... 442/46; 442/2; 442/43; 442/49; 442/59; 442/164; 428/220

(58) Field of Search ..... 442/2, 43, 46, 442/49, 208, 59, 164; D05/4, 47, 54, 58, 60; 428/220

(56) References Cited

FOREIGN PATENT DOCUMENTS

| | | | |
|---|---|---|---|
| JP | 57-147291 | * 9/1982 | ..... D06C/29/00 |
| JP | 59-63160 | 4/1984 | |
| JP | 2261117 | 10/1990 | |
| JP | 81-70244 | 7/1996 | |

* cited by examiner

*Primary Examiner*—Terrel Morris
*Assistant Examiner*—Ula C. Ruddock
(74) *Attorney, Agent, or Firm*—Sughrue Mion, PLLC

(57) ABSTRACT

To obtain a sheet capable of controlling the amount of passage of a fluid such as, to begin with wind, earth, water (including sea water) or their mixture, excellent in visibility of the sheet and endurance, also flexible, and having a good working efficiency by adopting a knitted or a woven structure obtained by arranging fiber groups A formed with slit state vacant spaces having a spacing of 0.5 mm or larger between adjacent fibers each other and fiber groups B as a lattice state, and having mesh state vacant spaces having widths of each 2 to 15 cm, and enclosed by the above fiber groups A and fiber groups B in an orientation direction of the fiber group A and in an orientation direction of the fiber group B

7 Claims, 1 Drawing Sheet

SHEET CAPABLE OF CONTROLLING QUANTITY OF PASSING FLUID

TECHNICAL FIELD

This invention relates to a sheet capable of controlling the amount of passage of a fluid such as wind, earth, water (including sea water) or their mixture, more concretely, to a sheet suitable for a wind preventing sheet for reducing the velocity of the wind, a snow preventing sheet for reducing the amount of blown in snow, an earth and sand preventing sheet for reducing the amount of washed away earth and sand or invasion thereof, or a bird preventing or an animal preventing sheet.

BACKGROUND ARTS

Heretofore, a curing sheet, etc., have been usually used as a wind preventing sheet. However, although these sheet are excellent only in the function of preventing the blowing in wind, they can not control the amount of wind and also have a defect in their limited uses and executed areas, since the sheets themselves are heavy and in addition, when they fill wind by receiving wind, an excessive tension is imposed on mounted parts thereof.

While in the case of using a mesh sheet obtained by performing a resin treatment on a mesh cloth as disclosed in Japanese Unexamined Patent Publication 8-170244, although the executed area can be extended, the function of preventing the blowing wind and strength thereof are inferior, and there is still a problem that it can not be used in an occasion such as in the cases of the field sports which are apt to be affected by an air stream, since the wind passed through the mesh becomes a turbulent flow, even if the desired wind preventing function is obtained by optimizing the ratio of vacant spaces of the mesh, For Example, in the case of controlling the wind surrounding a jumping stand in a skiing ground, the curing sheet can not be used since an executed area becomes wide and an excessive tension is imposed on the mounted parts thereof, and also obstructs the sights of spectators and judges. While by using the mesh sheet, it is difficult to control the wind velocity necessary for performing a jumping competition (less than 3 m/sec), and even if it can control the wind velocity, there are problems that the wind passing through the mesh becomes the turbulent flow to affect the competition and also strength thereof is weak and endurance thereof is inferior.

DISCLOSURE OF THE INVENTION

The object of this invention is to solve the problems of the above mentioned conventional technologies, and provide a sheet capable of controlling the amount of passage of a fluid consisting of, to begin with wind, earth, water (including sea water) or their mixture, excellent in visibility of the sheet and endurance, also flexible and having a good working efficiency, more concretely, a sheet suitable for a wind preventing sheet for reducing the velocity of the wind, a snow preventing sheet for reducing the amount of blown in snow, an earth and sand preventing sheet for reducing the amount of washed away earth and sand or invasion thereof, or a bird preventing or an animal preventing sheet.

As a result of research in order to accomplish the above object and carried out by the present inventor, it was found out that when spacings among groups of fibers arranged on a sheet having mesh state vacant spaces are controlled in a specific range, the desired sheet is obtained.

That is, by this invention, a sheet capable of controlling the amount of passage of a fluid is characterized in that the sheet is provided by arranging fiber groups A formed with slit state vacant spaces having a spacing of 0.5 mm or larger between adjacent fibers each other and fiber groups B as a lattice state, and containing a woven or knitted structure having mesh state vacant spaces having widths of each 2 to 15 cm and enclosed by the above fiber groups A and fiber groups B in an orientation direction of the fiber group A and in an orientation direction of the fiber group B.

THE BEST FORM FOR EXECUTING THE INVENTION

Figure 1:
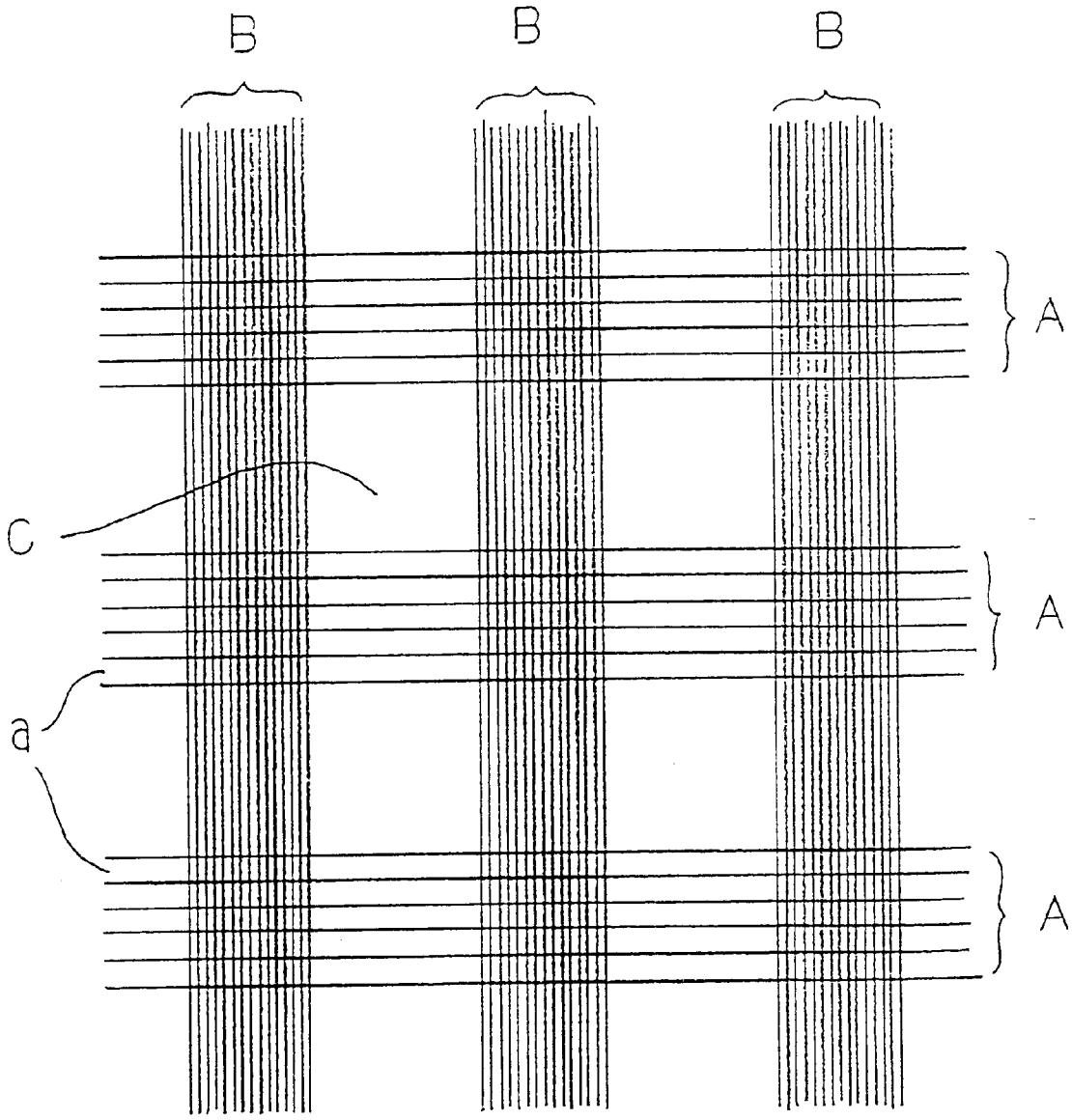
FIG. 1 is a plane figure showing one Example of the sheet of this invention.

The sheet of this invention is, as shown in the FIG. 1, constituted by arranging the fiber groups A and the fiber groups B and contains a woven or knitted structure formed with mesh state vacant spaces C enclosed by the fiber groups A and the fiber groups B.

It is necessary that the widths of the mesh state vacant spaces in the orientation directions of the fiber groups A and the fiber groups B are each 2 to 15 cm. When these widths are less than 2 cm, the passage amount of the fluid becomes too small, also the sheet becomes heavy and not only the executed area is limited but also the visibility of the sheet is poor. On the other hand, when the widths exceed 15 cm, it becomes difficult to reduce the flow velocity of the fluid.

The above mentioned widths can be set optionally according to the use or the desired flow rate in the range of 2 to 15 cm for each of the orientation direction of the fiber groups A and the orientation direction of the fiber groups B.

In the fiber groups A, adjacent fibers each other are arranged by putting spacings of 0.5 mm or larger, and it is necessary to form slit state vacant spaces (a). The slit state vacant spaces exhibit a moderate wind velocity reducing effect at a usual wind velocity (10 m/sec or less), and act for preventing that the fluid passed through the sheet (for Example wind) becomes a turbulent flow. While, under a strong wind (20 m/sec or more), it allows to pass through the wind as much as possible in order to prevent the sheet from breakage caused by an excessive tension imposed on the mounted parts, etc. of the sheet. Also, the visibility of the sheet can be improved.

The spacing of the adjacent fibers each other, that is, the width of the slit state vacant spaces can be set suitably according to the use or the desired flow rate, but if it becomes too large, the effect can not be developed sufficiently, and it is preferable to limit approximately by 5 mm at most.

There is no limitation as to the kind and thickness of the fiber constituting the fiber groups A, a filament yarn, a spun yarn, etc., of a synthetic fiber, a semisynthetic fiber, a regenerated fiber or a natural fiber can be optionally adopted, but in a view of a strength and a light fastness, a polyester multifilament yarn is preferable, and among them, it is preferable to use a so-called twisted yarn cord of polyester multifilament yarn obtained by paralleling plural primary twisted polyester multifilament yarns and performing a secondary twist thereto.

Also, in the fiber groups B, slit state vacant spaces may be formed by arranging the adjacent fibers each other at a spacing of 0.5 mm or more similarly to the fiber groups A, or the fibers may be combined into one unit by arranging the adjacent fibers each other more closely than those of the above fiber groups A.

There is no particular limitation in the kind and thickness of the fibers constituting the fiber groups B, and similarly to the fiber groups A, a multifilament yarn, a spun yarn, etc., of a synthetic yarn, a semisynthetic yarn, a regenerated yarn or a natural yarn can be optionally adopted, but it is preferable to use a non-twisted yarn of the polyester multifilament yarn, since the yarns are arranged compactly and apt to become stiff.

The widths of the above fiber groups A and B can be set in accordance with the desired flow rate and strength, but it is preferable to have 2 to 15 cm similarly to the width of the mesh state vacant spaces. When the width is less than 2 cm, sometimes the strength is insufficient or the endurance become inferior. On the other hand, when the width exceeds 15 cm the passage amount of the fluid becomes less, the turbulent flow may be apt to occur, and the visibility of the sheet is reduced.

To the above mentioned woven or knitted fabric, a resin may be impregnated or attached in order to improve a light fastness, abrasion property, etc. As to the resin for impregnation or attachment, a polyvinyl chloride, a polyurethane, a polyethylene, a chlorinated polyethylene or a polyester are cited, but in view of a weather resistance and a cost, the polyvinyl chloride is preferable.

The strengths of the sheet in the orientation direction of the fiber groups A and in the orientation direction of the fiber groups B obtained by the above method, are each preferably 100 kg/10 cm to 1000 kg/10 cm. If the strength is less than 100 kg/10 cm, sometimes, the sheet is apt to be broken and the endurance becomes inferior. On the other hand, the strength exceeds 1000 kg/10 cm, the sheet becomes heavy and stiff and sometimes the working efficiency is reduced.

Also, the total ratio of vacant spaces of the sheet obtained by the above method, is preferably 20 to 80%, more preferably 40 to 70%. In the case that the above ratio of vacant spaces is less than 20%, the sheet itself becomes heavy, and for Example it is used for a wind preventing sheet, sometimes an excessive tension is imposed on the mounted parts thereof by filling the wind. On the other hand, when the ratio of vacant spaces exceeds 80%, it is sometimes difficult to control the wind velocity.

Therefore, in the case of using the above sheet as the wind preventing sheet, it is preferable to control the wind velocity reduction rate in a range of 30 to 70% at 20 m/second wind velocity, but in the case that the ratio of vacant spaces exceeds 80%, the amount of air passage is too much and it is difficult to control the wind velocity reduction rate within the above range.

In the sheet in this invention, it is poosible to join plural numbers thereof together easily. That is, as described in Japanese Unexamined Patent Publication 55-107594, it is known that a method of forming loops at the end part of the cloth and joining the cloths by threading a joining pin through the loops, and the formation of the loops are easily performed in the sheet of this invention.

In other words, it is possible to form loops consisting of the fiber groups A at the end part of the sheet by turning back the fiber group B at the end part of the sheet in the direction of the orientation direction of the fiber groups B and adhering to another fiber groups B in the same sheet. In this case, it is preferable to set a ratio of an apparent diameter of a fiber constituting the fiber groups A to the width of the slit state vacant spaces in a range of (1:0.8) to (1:10), since the overlapping of loops each other in joining them is easily performed. Further, the apparent diameter and the width of the slit state vacant spaces are values obtained from a photograph taken at the measurement of the total rate of vacant spaces described in the later section.

As a method for adhering the fiber group B to another fiber group B in the same sheet, it is possible to adopt an optional method such as a method of sewing or hot melt adhesion after piling the fiber groups B each other, etc.

Also, in the case of adhering the fiber group B to another fiber group B, it is preferable for increasing the loop strength to adhere the fiber group B not to adjacent fiber group B but to the next fiber group by leaping at least one row.

EXAMPLES

This invention is explained concretely in the following Examples, but this invention is not limited by these Examples. Further, the methods for measurements of physical properties used in the Examples are as follows;

(1) Total Rate of Vacant Spaces

A sheet is placed on a stage glass of a light box equipped with 10 W fluorescent light, and a transmitted light photography is taken. Further, in taking the photography and printing, the magnitudes of taking the photography and printing are adjusted so as to reproduce the one recurrent unit of the sheet at an equal magnitude on a printing paper.

In the above photograph. since the vacant spaces consisting mainly of the mesh state vacant spaces and the slit state vacant spaces are reproduced as a white bright region, the total sum of the area of whole vacant spaces presenting in one recurring unit (expressed as $S_1$), and an area occupied by the one recurring unit (expressed by $S_0$) are measured and the total rate of the vacant spaces are calculated by using an equation below. Further, the measurements were performed by 5 times on one kind of the sheet, and a mean value thereof was set as the value for the total rate of the vacant spaces.

$$\text{Total Rate of Vacant Spaces } (\%) = S_1/S_0 \times 100$$

Also, the apparent diameter and the width of the slit state vacant spaces of the fibers constituting the fiber group A was also measured from the above mentioned photograph.

(2) Reduction Rate of Wind Velocity

By using an air passage tester (Textest Co., Ltd., FX3300), and blowing an air having a constant wind velocity (expressed by $W_1$) to the sheet for measuring the wind velocity after passing through the sheet (expressed as $W_2$), and the reduction rate is calculated by using an equation below. Further, the measurements were performed by 5 times on one kind of the sheet, and the mean value thereof is set as the value of the reduction rate.

$$\text{The Wind Velocity Reduction Rate} = W_2/W_1 \times 100$$

Also, the degrees of turbulent flow generation were expressed in three grades as ○ (almost no generation of the turbulent flow), Δ (slight generation of the turbulent flow) and X (generation of the turbulent flow).

(3) Joining Capability of the Sheets

By joining 30 sheets having a width of 2 m and a length of 15 m in width direction, the easiness of works for the installation as a wind preventing sheet, was assessed functionally.

(4) Visibility of the sheet of the Sheet

The quality of the sight of the wind preventing sheet installed by the above method was assessed functionally.

Example 1

A knitted fabric having a mesh state vacant spaces was obtained by using a warp and weft inserting raschel knitting machine (24G), supplying a high strength polyester multifilament yarn (made by Teijin Limited, BHT1000-192) as a warp inserting yarn to a reed L3 at 32 in 38 out so as to make a structure having 00/11 and a density of 24 yarns/in, a high strength polyester multifilament yarn (made by Teijin Limited, BHT50-24) as an entangling yarn to reeds L1, L2 at 32 in, 38 out by 2 bars so as to make a structure having L1 of 10/01 and L2 of 01/10, and further, a yarn obtained by paralleling 4 yarns of a high strength polyester multifilament yarn (made by Teijin Limited, BHT1000-192) and twisting by 40 t/m as a weft inserting yarn, and performing the knitting at 9 in, 9 out at a density of 75 yarns/in.

Then, a wind preventing sheet was obtained by attaching and impregnating a polyvinyl chloride to the above knitted fabric with a dip process.

Example 2

A woven fabric having mesh state vacant spaces was obtained by arranging 3 cm of a high strength polyester multifilament yarn (made by Teijin Limited, BHT1000-192) and then 4.5 cm of a blank spacing alternately as a warp yarn, and weaving 3 cm with a yarn obtained by paralleling 2 yarns of a high strength polyester multifilament yarn (made by Teijin Limited, BHT1000-192) and twisting by 80 t/m, and then 4.5 cm of blank beating as a weft yarn.

Then a wind preventing sheet was obtained by attaching and impregnating a polyvinyl chloride to the above woven fabric with a dip process.

Example 3

A knitted fabric was obtained similarly to the Example 1 except for supplying a high strength multifilament yarn (made by Teijin Limited, BHT150-48) as the entangling yarn to reeds L1, L2 at 32 in, 38 out by 2 bars so as to make a structure having L1 of 10/01 and L2 of 10/12, and a yarn obtained by paralleling 6 yarns of a high strength multifilament yarn (made by Teijin Limited, BHT1000-192) and twisting at 40 t/m as the weft inserting yarn, and performing the knitting at 6 in, 6 out at a density of 5 yarns/in.

Example 4

A knitted fabric was obtained by using the warp and weft inserting raschel knitting machine, supplying a yarn obtained by paralleling 4 yarns of a high strength multifilament yarn (made by Teijin Limited, BHT1000-192) and twisting by 40 t/m to reed L3 (as a warp inserting yarn) by 12 in, 12 out so as to make 9 yarns/in, a high strength polyester multifilament yarn (made by Teijin Limited, BHT50-24) as an entangling yarn at 12 in, 12 out by 2 bars so as to make a structure of L1 of 10/01 and L2 of 01/10, and further, a yarn obtained by paralleling 6 yarns of a high strength polyester multifilament yarn (made by Teijin Limited, BHT1000-192) and twisting by 40 t/m as a weft inserting yarn, and performing the knitting at 6 in, 6 out at a density of 5 yarns/in.

Then, a wind preventing and bird preventing sheet were obtained by attaching and impregnating a polyvinyl chloride to the above knitted fabric with a dip process.

Comparative Example

A woven fabric was obtained similarly to the Example 2, except for arranging 3 cm of a high strength polyester multifilament yarn (made by Teijin Limited, BHT500-96) at 48 yarns/in and then 5 cm blank spacing alternately as a warp yarn, and weaving 3 cm of a high strength multifilament yarn (made by Teijin Limited, BHT1000-192) at a density of 40 yarns/in and then 5 cm of blank beating.

The physical properties of the woven or knitted fabrics constituting each of the above sheets and of the sheets are shown in Table 1.

TABLE 1

| | EX. 1 | Ex. 2 | Ex. 3 | Ex. 4 | C. Ex. 1 |
|---|---|---|---|---|---|
| Fiber group A | | | | | |
| Width (mm) | 34 | 30 | 30 | 30 | 30 |
| Apparent diameter of constituting fiber (mm) | 1.1 | 0.8 | 1.1 | 1.3 | — |
| Width of slit state vacant space (mm) | 3.0 | 1.5 | 3.0 | 3.8 | None |
| Fiber group B | | | | | |
| Width (mm) | 30 | 30 | 30 | 30 | 30 |
| Apparent diameter of constituting fiber (mm) | 0.5 | 0.4 | — | 1.2 | — |
| Width of slit state vacant space (mm) | 0.5 | 0.6 | None | 1.6 | None |
| Width of mesh state vacant space (cm) | | | | | |
| Orientation direction of A | 36 | 45 | 30 | 30 | 50 |
| Orientation direction of B | 40 | 45 | 40 | 31 | 50 |
| Weight of sheet (g/m$^2$) | 325 | 290 | 400 | 380 | 510 |
| Strength of sheet (kg/10 cm) | | | | | |
| Orientation direction of A | 357 | 133 | 374 | 640 | 280 |
| Orientation direction of B | 300 | 140 | 310 | 786 | 233 |
| Total rate of vacant spaces (%) | 62 | 64 | 61 | 60 | 39 |
| Wind velocity reducing rate (%) | | | | | |
| Wind velocity at 6 m/sec | 58 | 48 | 51 | 52 | 61 |
| Wind velocity at 20 m/sec | 45 | 40 | 52 | 43 | 60 |
| Wind velocity at 37 m/sec | 28 | 25 | 30 | 18 | 50 |
| Generation of turbulent flow | ○ | ○ | Δ | ○ | X |
| Visibility of the sheet of sheet | Good | Good | Good | Good | Bad |
| Joining property of sheet | Good | Good | Good | Good | Bad |

In the Example 1, 2 and 4, slit state vacant spaces having a spacing of 0.5 mm or larger between adjacent fibers each other in both fiber groups A and B were formed, then a good wind velocity reduction rate was exhibited, also the turbulent flow was not generated and the visibility of the sheet is excellent.

On the other hand, in the Example 3, slit state vacant spaces were not formed in the fiber group B, and the turbulent flow was slightly generated. Also, in the Comparative Example 1, the slit state vacant spaces were not formed in both fiber groups A and B, then the turbulent flow was generated and the visibility of the sheet was inferior.

The Possibility of Use in Industry

According to this invention, it is possible to obtain a sheet capable of controlling the passage amount of a fluid such as wind, earth, water (including sea water) or their mixture, excellent in visibility of the sheet and endurance, also flexible, having a good working efficiency, and capable of being suitably used as a wind preventing sheet for reducing the wind velocity, earth and sand preventing sheet for reducing the amount of washing away or a snow preventing sheet for reducing the amount of blowing in snow, an invasion of the earth and sand, or a bird or an animal preventing sheet.

What is claimed is:

1. A sheet for controlling the passage of a fluid comprising: two groups of fibers, A and B, with fiber group A crossing fiber group B, forming a mesh having mesh spacing between fiber groups of between 2 cm and 15 cm; the fibers of fiber group A having a mesh width between fibers of 0.5 mm or more between adjacent fibers and wherein the fibers of fiber group B have a mesh width between fibers of 0.5 mm or more between adjacent fibers.

2. The sheet of claim 1 wherein the widths of fiber groups A and B are each between 2 cm and 15 cm.

3. The sheet of claim 1 wherein the sheet fibers are impregnated with a resin.

4. The sheet of claim 1 wherein the strength of the sheet in the directions of the fibers in fiber groups A and B is between 100 kg/10 cm and 1000 kg/10 cm.

5. The sheet of claim 1 having a total percentage of vacant space between 40% and 70%.

6. The sheet of claim 1 wherein the ratio of the apparent diameter of a fiber in fiber group A to the mesh width between fibers is between 1:0.8 and 1:10.

7. The sheet of claim 1 having loops formed by folding back the fibers of one of the fiber groups.

* * * * *